US005827092A

United States Patent [19]

Minich

[11] Patent Number: 5,827,092

[45] Date of Patent: Oct. 27, 1998

[54] FILTERED ELECTRICAL ADAPTER AND CONNECTOR

[75] Inventor: Steven Eric Minich, Glen Rock, Pa.

[73] Assignee: The Whitaker Corporation, Wilmington, Del.

[21] Appl. No.: 882,249

[22] Filed: Jun. 25, 1997

Related U.S. Application Data

[63] Continuation-in-part of Ser. No. 710,471, Sep. 13, 1996.

[51] Int. Cl.[6] ..... H01R 13/66

[52] U.S. Cl. ..... 439/620; 439/638

[58] Field of Search ..... 439/620, 638; 333/181–185

[56] References Cited

U.S. PATENT DOCUMENTS

| | | | |
|---|---|---|---|
| 3,760,335 | 9/1973 | Roberts | 339/99 |
| 4,772,224 | 9/1988 | Talend | 439/620 |
| 5,151,054 | 9/1992 | Briones et al. | 439/620 |
| 5,213,522 | 5/1993 | Kojima | 439/620 |
| 5,397,250 | 3/1995 | Briones | 439/620 |
| 5,562,499 | 10/1996 | Minich | 439/620 |

*Primary Examiner*—Gary F. Paumen

[57] ABSTRACT

A filtered electrical connector comprises a plurality of contact terminals held in an insulative housing. The contact terminals comprise a pin and a root. The housing comprises a support, an anchor, and a collar. A conductive shield is disposed on the housing. A filter element is disposed between the collar and the root and engages the shield.

35 Claims, 7 Drawing Sheets

FILTERED ELECTRICAL ADAPTER AND CONNECTOR

RELATED APPLICATION DATA

Continuation in part application of patent application Ser. No. 08/710,471, filed Sep. 13, 1996.

FIELD OF THE INVENTION

The present invention is related to filtered electrical connectors of the type in which a filter element is added to the electrical connector for filtering high voltage transient surges. More particularly the present invention is also related to filtered adapters in which two connectors are positioned back to back with capacitors electrically connected to at least some of the connector terminals.

BACKGROUND OF THE INVENTION

There is known a multiple position electrical connector having an insulating shell housing a number of contacts. In an adapter, it is also known to position two multiple position connectors back to back wherein contacts of each connector in an adapter are electrically joined to respective contacts in a second connector of the adapter. The contacts of each connector in the adapter are electrically interconnected by known means, which is typically a wire or other intermediate conducting element. It is also known and desirable to insert filter elements into connectors and adapters. A common filter element is a capacitor which makes electrical contact to a single contact of a connector or adapter. The capacitor is typically interconnected between a single contact and reference potential. Filtered connectors and adapters can provide protection for equipment attached to the connectors and adapters from transient voltage surges.

U.S. Pat. No. 5,562,499, commonly owned by the present Assignee discloses a filtered multiposition adapter in which multiple contacts and a ground bar are held in an insulative housing. A filter element, typically a capacitor, is positioned and electrically interconnected between each contact of the adapter and the ground bar. Each contact has an insulation displacement section. A wire terminated in the insulation displacement section captivates the filter element between the wire, the contact, the housing, and the ground bar. Advantageously, a filtered adapter can be easily assembled without the use of solder. Disadvantageously, however, this adapter is not capable of withstanding a 2500 volt transient surge due to the size of the capacitors used for filtering without a change of tooling and increasing the size of the connector. There is a need, therefore, for a multiposition filtered connector and adapter that can withstand a 2500 volt transient voltage surge in a small connector package.

SUMMARY OF THE INVENTION

It is an object of an embodiment of the present invention to overcome the disadvantages of the prior art and specifically to provide a filtered electrical connector and adapter capable of withstanding a 2500 volt transient surge in a small connector package.

It is also an object of an embodiment of the present invention to provide a filtered electrical connector and adapter that is easily assembled.

Accordingly, a filtered electrical connector comprises a plurality of contact terminals held in an insulative housing. The contact terminals comprise a pin and a root. The housing comprises a support, an anchor, and a collar. A conductive shield is disposed on the housing. A filter element is disposed between the collar and the root and engages the shield.

It is a feature of an embodiment of the present invention that a filter element is interposed between a collar of the housing and a contact root.

It is a further feature of an embodiment of the present invention that a filter element is electrically connected between the contact root and the shield.

It is an advantage of an embodiment of the present invention that a connector and adapter are capable of withstanding a 2500 volt transient surge.

It is a further advantage of an embodiment of the present invention that a connector and adapter are easily assembled.

It is another advantage of an embodiment of the present invention that a connector and adapter provide for high contact density in a minimally sized package.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
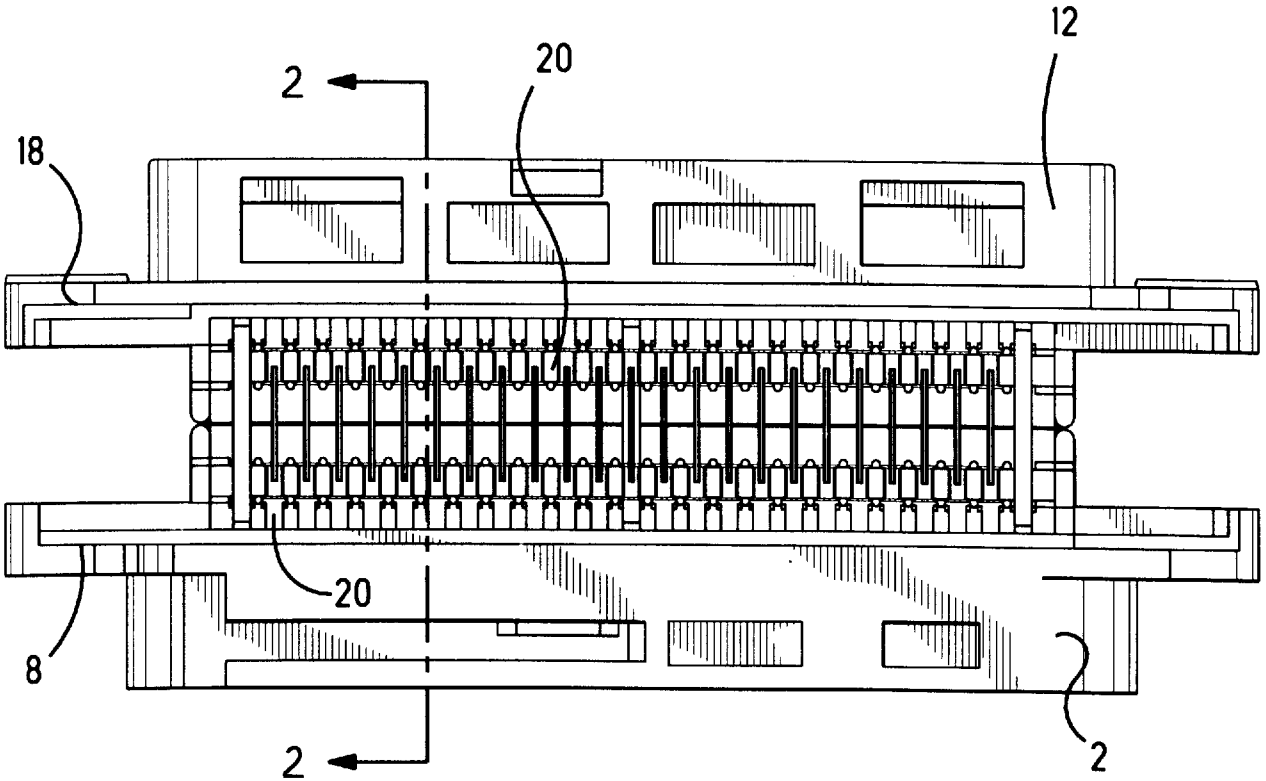
FIG. 1 is a plan view of an unfiltered multiple position adapter.

Although the invention disclosed herein can be employed with a number of electrical connector configurations, it is particularly adapted for use with electrical connectors and adapters such as those disclosed in U.S. Pat. No. 3,760,335 and U.S. Pat. No. 5,562,499, the teachings of which are specifically incorporated by reference herein. With reference to FIG. 1 of the drawings, there is shown a plan view of a known unfiltered multiple position adapter. The adapter comprises a first housing (2) which in a preferred embodiment is a plug type housing, juxtaposed to a second housing (12) which in a preferred embodiment is a receptacle. The first and second housings (2,12) are disposed in back to back relation so as to present a receptacle type connector (12) in an opposite direction to a plug type connector (2) to create the adapter. The present invention is equally applicable to an embodiment comprising a single housing which when terminated to a cable constitutes a cable assembly. The first and second housings (2,12) can take on either the plug or receptacle configuration, there being three permutations of adapter available: plug-plug, plug-receptacle (as disclosed), and receptacle-receptacle. Each housing is made of an insulating polymer material such as VALOX (a registered trademark of General Electric) and is typically fabricated by an injection molding process. Each insulative housing (2,12) holds a plurality of contact terminals (20) therein. The contact terminals (20) are made of conductive material, typically metal and are disposed in side by side relation on standard centerline spacings, typically 0.085 inches.

Figure 2:
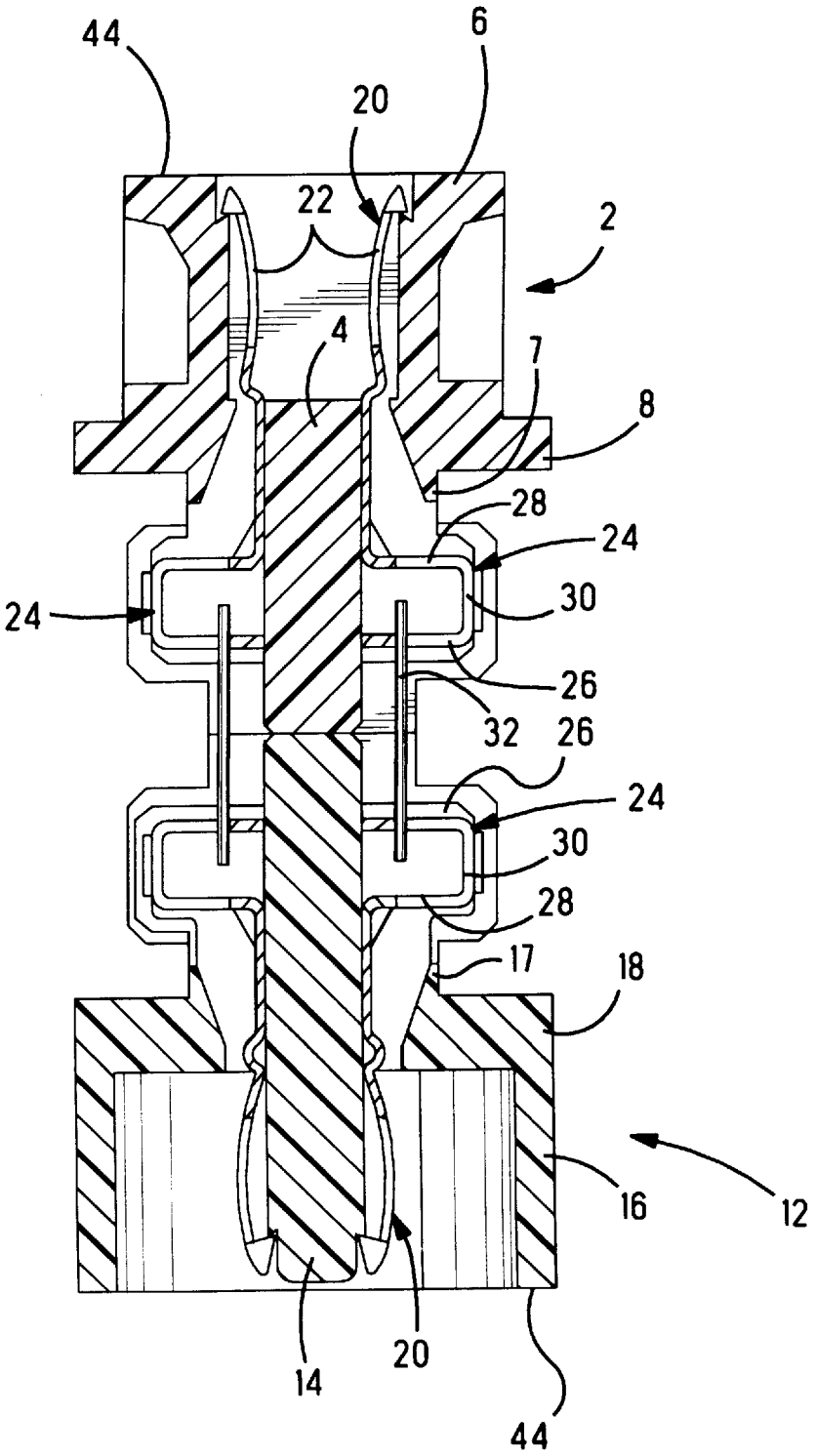
FIG. 2 is a cross section of the unfiltered multiple position adapter shown in FIG. 1 of the drawings.

With reference to FIG. 2 of the drawings, there is shown a cross sectional view of the unfiltered connector illustrated in FIG. 1 of the drawings. Each housing (2,12) further comprises a support (4,14) and an shroud (6,16). The support (4,14) comprises a planar member of insulating material that traverses through the center of the housing (2,12). The contact terminals (20) are positioned on either side of the support (4,14) to create two opposite rows of contacts (20) held in the housing (2,12). The support (4,14) physically separates opposite contact terminals (20) from each other. In a plug housing (2), the support (4) limits lateral deflection of the flexible contact terminals (20) during mating of the connector. In a receptacle housing (12), the support (14) does not extend as far as the contacts thereby permitting reception of a mating plug (not shown). The housing (2,12) further comprises a mating section or shroud (6,16) integral with an anchor (7,17) and a collar (8,18). The shroud (6,16) either receives or is received by a complementary mating section of a mating connector. The anchor (7,17) comprises a length of insulating material substantially parallel to the planar support (4,14). Each contact terminal (20) is held between the support (4,14) and the anchor (7,17) of the housings (2,12). Each contact terminal comprises a pin (22) and root (24). The pin (22) is directed towards a mating end (44) of the housing (2,12) and provides the connector's function. The pin (22) of the contact terminal (20) can take on a number of configurations. Two of the configurations, the receptacle style and the plug style of contact pin are shown in FIG. 2 of the drawings. The root (24) is at an opposite end of the contact terminal from the pin (22). The root (24) comprises an insulation displacement section (26), a plate (28), and a spacer (30), the plate (24) and the insulation displacement section (26) at right angles to the intermediate spacer (30). The insulation displacement section (26) of the root (24) is of conventional design comprising a tapered slot formed in a metal plate. A connecting wire (32) is terminated in each insulation displacement section (26) of opposite contact terminals (20). In the adapter configuration the connecting wire (32) electrically interconnects the contact terminal (20) of the first housing (2) to the contact terminal (20) of the second housing (12) effecting electrical interconnection between the contact pin (22) of the first housing (2) to the contact pin (22) of the second housing (12). The plate portion (28) of the root (24) comprises a flat conducting portion integral with the pin (22) of the contact terminal (20). The plate portion (28) is disposed at a right angle relative to the pin (22). In the preferred embodiment, the plate portion (28) is integral with the pin (22) and is formed by making a right angle bend in the contact terminal (20). By virtue of the fact that the contact terminal (20) is made of metal, the right angle configuration between the pin (22) and the plate (28) provides for a certain amount of resilience between the pin (22) and the plate (28), the benefit of which will become apparent hereinafter. The insulation displacement section (26) and the plate (28) are interconnected through a conductive spacer (30). In a preferred embodiment, the spacer (30) takes on the form of a section of contact terminal that is continuous and integral with the insulation displacement section (26) and the plate (28) of the root (24). In the adapter embodiment, the length of the spacer portion (30) of the root (24) is sufficient to provide for insertion and retention of the connecting wire (32) into the insulation displacement portion (26), while also permitting clearance between the wire (32) and the plate (28).

Figure 3:
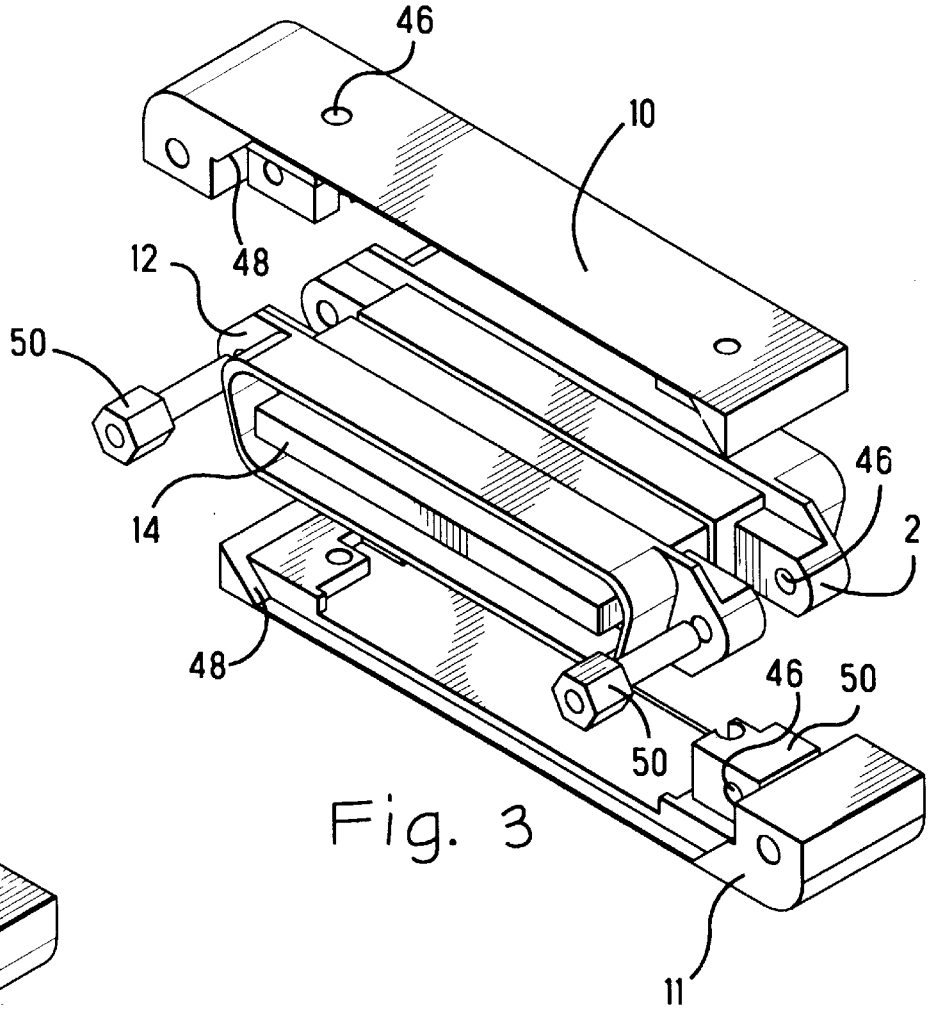
FIG. 3 is an exploded perspective view of an adapter according to the teachings of the present invention.
Figure 4:
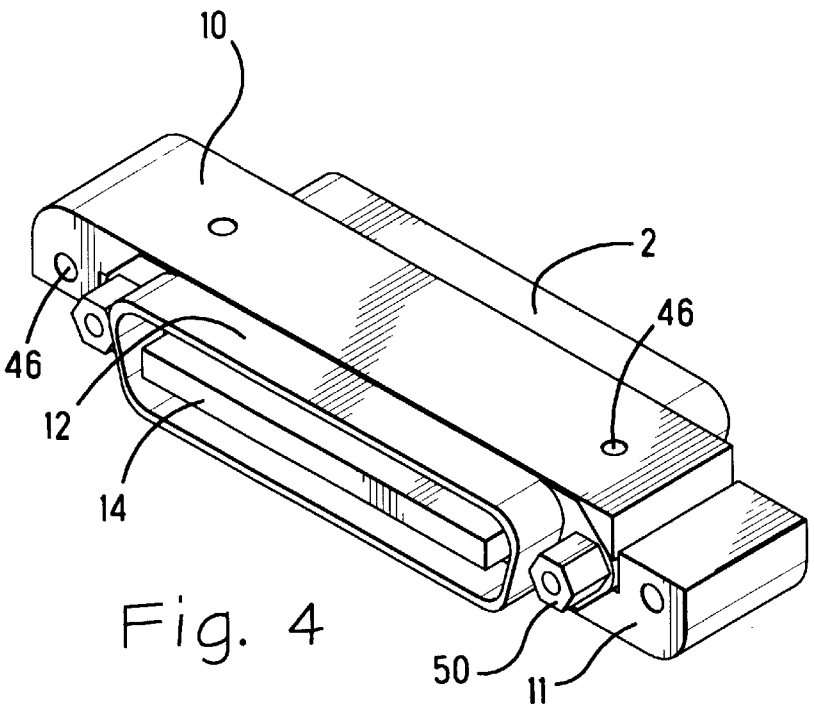
FIG. 4 is an assembled perspective view of an adapter according to the teachings of the present invention.

With reference to FIGS. 3 and 4 of the drawings, there is shown an exploded and assembled perspective view of a filtered adapter according to the teachings of the present invention. FIGS. 3 and 4 show a first shield (10) mounted over both the first and second housing (2,12) to enclose one half of the adapter. A second shield (11) encloses a remaining half of the adapter. The first and second shields (10,11) are made of an electrically conductive material, typically metal and are diecast. As illustrated in the drawings, various screw holes (46), chamfers (48), and securing members (50) may be included in the shields (10,11) in order to provide full shielding and appropriate retention of the shields (10,11) to each other and the housings (2,12).

Figure 5:
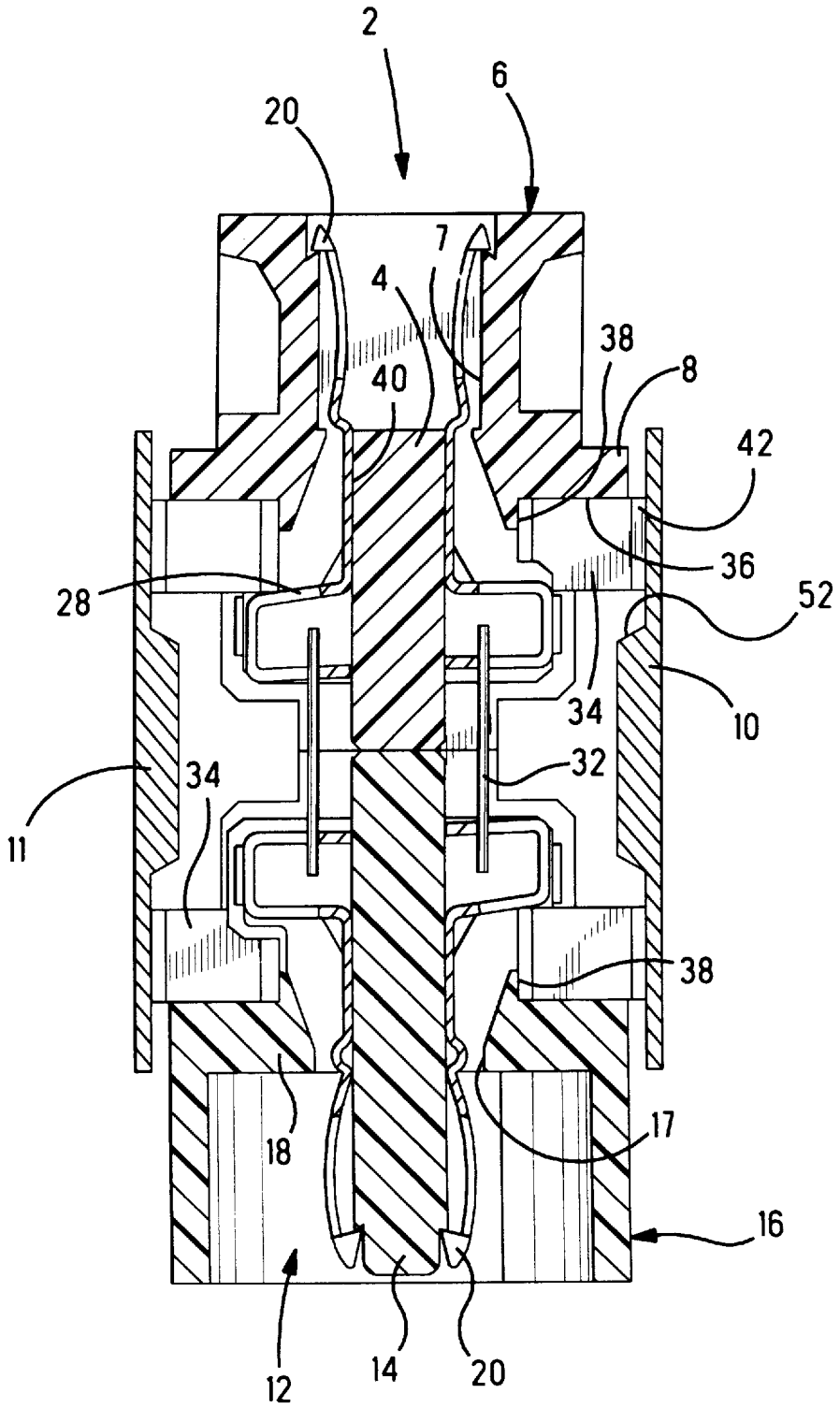
FIG. 5 is a cross section of an assembled adapter according to the teachings of the present invention.

With reference to FIG. 5 of the drawings, there is shown a cross sectional view of an assembled filtered adapter according to the teachings of the present invention. Filtering of the adapter is accomplished by insertion of a filter element (34) into a recessed area created by the plate (28) and the collar (8,18). A filter element (34) as shown in the embodiment of FIG. 5 of the drawings comprises a chip capacitor having the dimensions appropriate for insertion between the collar (8,18) and the root (24) of the contact terminal. Specifically, a chip capacitor is held between the plate (28) and an inside wall (36) of the collar (8,18). For a multiple position adapter on center lines of 0.085 inches and capable of withstanding a 2500 VAC surge for 60 seconds, the preferred chip capacitor size has a length of 0.180 inches (4,57 millimeters) a width of 0.125 inches (3.18 millimeters) and a maximum thickness of 0.24 inches (0.610 millimeters) and a value of approximately 0.100 micro Farads. The width section of the filter element (34) is selected based upon the distance between an inside wall (36) of the collar (8) and the plate (28). Advantageously, the plate (28) is deflected slightly away from the inside wall (36) upon insertion of the filter element (34) therein. The resilience of the plate (28) relative to the rest of the contact terminal (20) provides a retention force on the filter element (34) which also assures positive electrical contact between a first contact section **(42*a*) of the filter element (34) and the plate (28)**.

The shroud (6,16), further comprises the inside wall (36) and a floor (38). The inside wall (36) and the floor (38) of the shroud (6,16) are integrally formed at right angles relative to each other. The contact terminal (20) is positioned so that the pin (22) is held between the support (4,14) and the anchor (7,17) to create an area of mutual engagement (40). The pin (22) extends past the area of mutual engagement (40) and past an end of the floor (38) a certain distance to the root (24). The plate (28) is at a right angle relative to the pin (22) and is parallel to the inside wall (36). The chip capacitor (34) is inserted so that a length of the capacitor (34) engages the inside wall (36). A portion of the width of the capacitor engages the floor (38) and another portion of the capacitor engages the plate (28). The filter element (34), therefore, is received by the combination of the inside wall (36), the floor (38), and a portion of the plate (28). The contact section (42) of the filter element (34) electrically engages the plate (28) thereby electrically connecting to the pin (22) and the insulation displacement section (26). The inside wall (36) has a length which is no bigger than a length of the chip capacitor. In order to accommodate manufacturing tolerances of standard chip capacitors, the length of the inside wall (36) is chosen so that a maximum length can accommodate a minimum length of a chip capacitor while still exposing a second contact section (42*b*) of the chip capacitor (34).

The first shield (10) is disposed over the first and second housing (2,12) and physically engages the second contact section (42*b*) of the filter element (34). In a preferred embodiment, the shields (10,11) have a cross sectional profile that is thicker in a center of the shield. An alignment shoulder (52) is created by the transition between the thicker central section and the thinner outer section. The alignment shoulder (52) provides resistance to the filter element (34) pivoting off the floor (38) and thereby maintains appropriate alignment of the filter element (34) relative to the plate (28). A bead of conductive RTV or other conductive adhesive may be placed along the shield (10,11) to improve connectivity between the shield (10,11) and the filter element (34). The shield (10,11) is then mounted to the housing (2) in known manner, preferably screws, to create the assembled filtered adapter.

Figure 6:
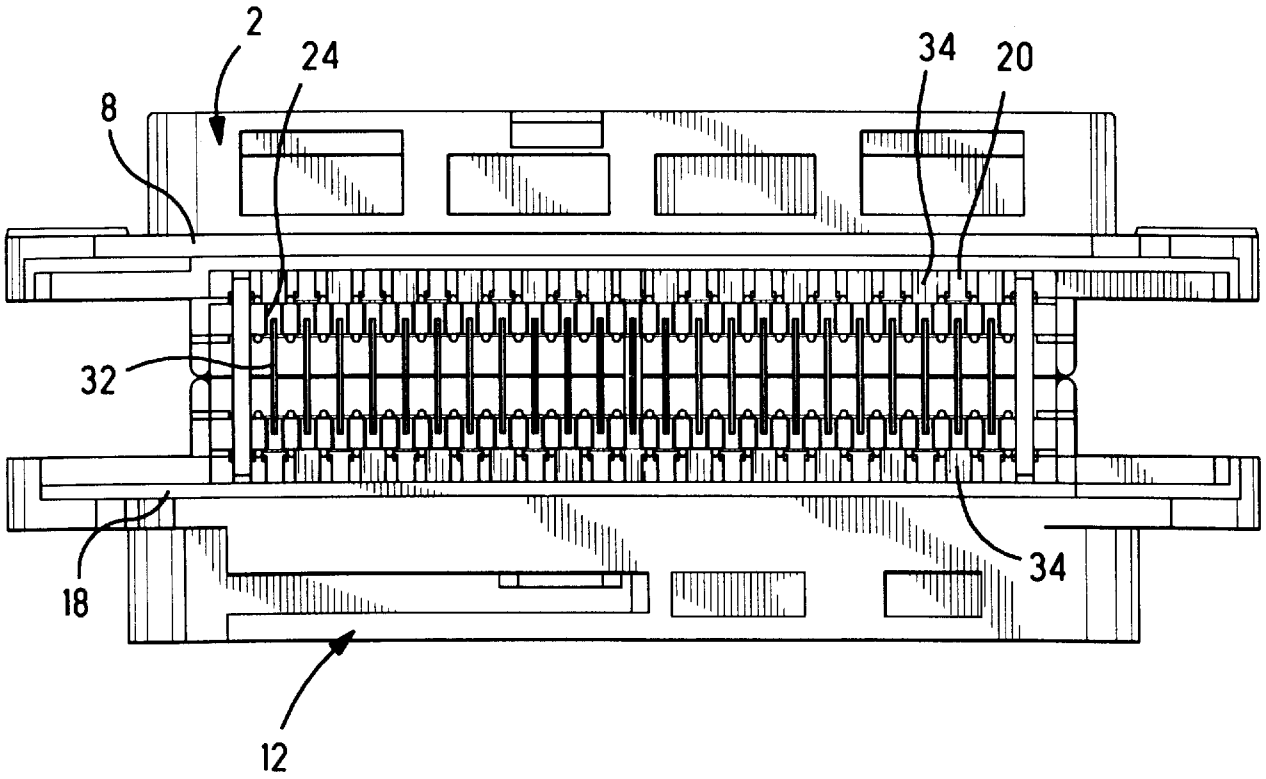
FIG. 6 is a plan view of a filtered adapter shown without a shield in order to expose the positioning of the filter elements therein according to the teachings of the present invention.

With reference to FIG. 6 of the drawings, there is shown a plan view of an adapter according to the teachings of the present invention which is populated with chip capacitors (34). In a preferred embodiment, only a single capacitor is used for each contact terminal (20). In this embodiment therefore, and as shown in FIG. 6, chip capacitors are populated as described hereinabove at alternate locations.

Figure 7:
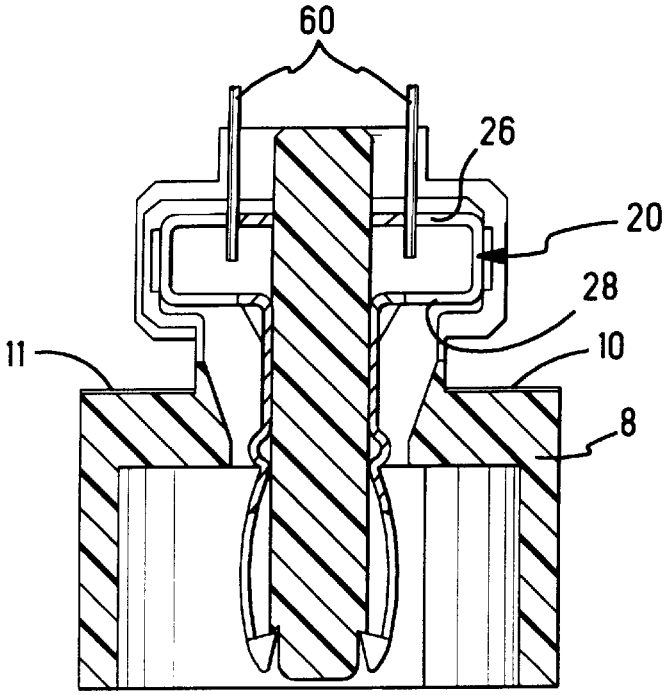
FIG. 7 is a cross sectional view of an unfiltered connector of a cable assembly.
Figure 8:
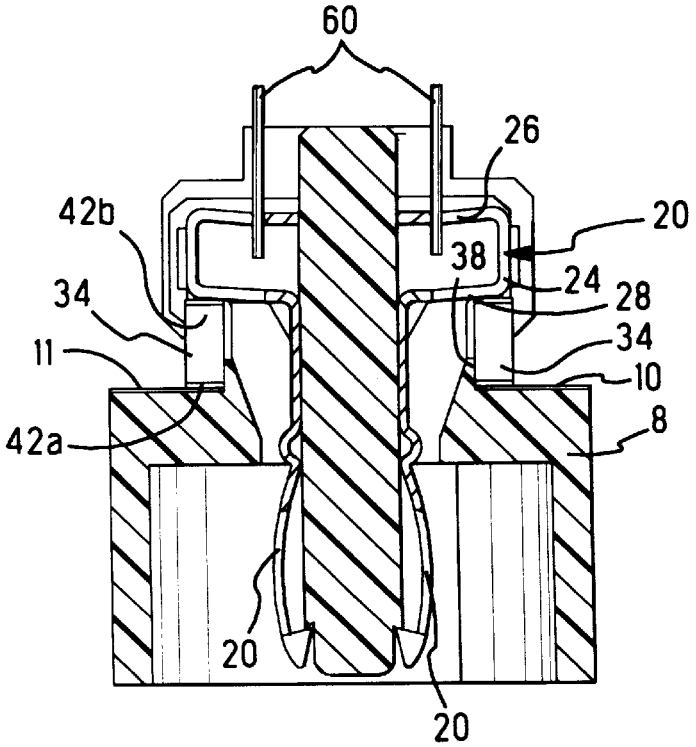
FIG. 8 is a cross sectional view of a filtered embodiment of the cable assembly connector shown in FIG. 7.
Figure 9:
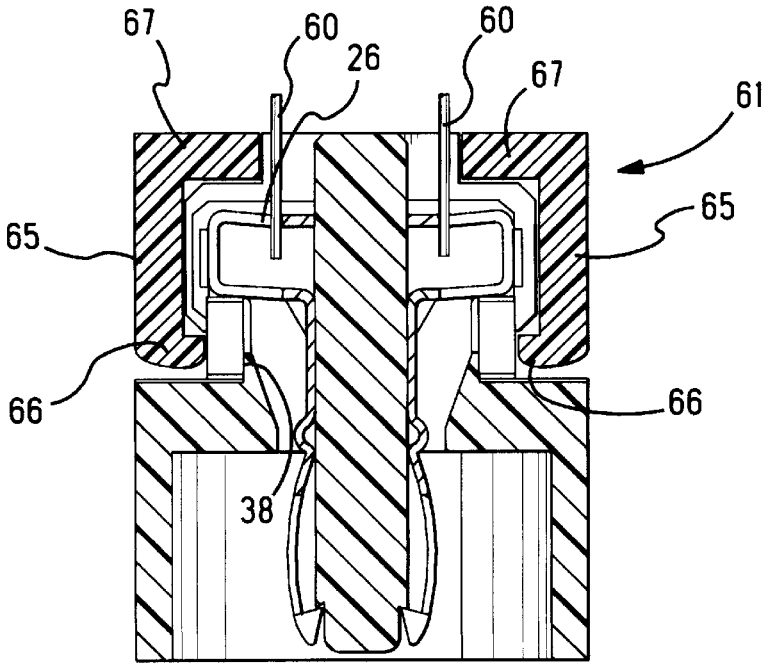
FIG. 9 is a cross sectional view of an alternate embodiment of a filtered connector according to the teachings of the present invention.
Figure 10:
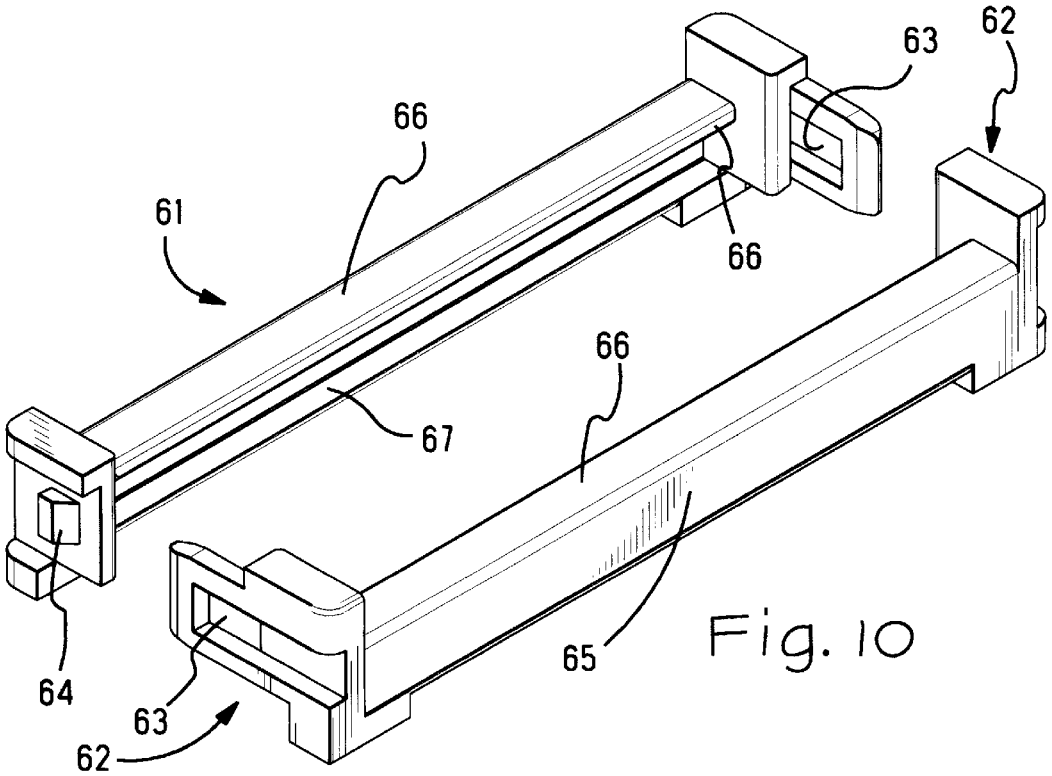
FIG. 10 is a perspective view of a strain relief according to the teachings of the present invention.

With respect to FIGS. 7 and 8 of the drawings, there is shown an alternate embodiment of the cable assembly having a filtered electrical connector according to the teachings of the present invention in which each shield (10, 11) comprises a sheet of conductive material which is disposed along the inside wall (36) of the collar (8). Each shield (10, 11) extends over the entire length of the collar (8) and is fashioned to make physical and electrical contact with the securing members (50) upon connection of the connector to a bulkhead. The securing members (50) make electrical contact with the shields (10, 11) in the bulkhead to which the connector is attached in order to ground the shield to chassis potential. In the embodiment shown in FIG. 8 of the drawings, the filter element (34) is positioned with the first contact section (42*a*) facing and in direct contact with the first shield (10) disposed on the collar (8). The second contact section (42*b*) faces and is in direct contact with the plate (28). Resilience in root (24) provides for a frictional fit and retention of the filter element (34) in the recess created by the collar (8), the floor (38) and the root (24). In the embodiment of FIG. 8, the filter element (34) comprises a standard 1206 chip capacitor having a size of 0.120 inches (0.305 cm) in length extending from collar (8) to root (24), 0.060 inches (0.152 cm) in width and 0.050 inches (0.127 cm) in depth and has a nominal value of 470 pf. In the cable assembly embodiment, the connector is fully populated by associating one of a plurality of the filter elements (34) with each contact terminal (20). Conductors (60) of a cable in the cable assembly terminate in the IDC section (26) of the filtered connector. A strain relief (61) for the cable assembly comprises hermaphroditic halves made by injection molding, a thermoplastic polymer, such as VALOX. Each strain relief half has a C-shaped cross section with retention tabs (62) at opposite ends. For each strain relief half, one tab has a notch (63) and the other has a complimentary barb (64) that interfits with the notch (63), as shown in FIG. 10 of the drawings. Two of the strain relief halves fit over the upper and lower portions of the connector that contain the root (24) the notches (63) and barbs (64) interfitting to retain the strain relief (61) to the housing. A wire retention portion (67) of the cross section is disposed in right angle relation to a bridging portion (65) which in turn is disposed in right angle relation to a filter element retention portion (66). The wire retention portion (67) and the filter element retention portion (66) prevent movement of the filter element (34) and the conductors (60) in a direction away from the floor (38) and IDC section (26) respectively.

Other advantages of the invention are apparent from the detailed description by way of example, and from accompanying drawings, and from the spirit and scope of the appended claims.

I claim:

1. A filtered electrical connector comprising a plurality of contact terminals comprising contacts held in an insulative housing, the contact further comprises a contact pin and a conductive plate perpendicular to the mating direction of the connector and in electrical communication with said contact pin, the housing further comprising a collar parallel to and spaced away from said conductive plate creating a recess between said conductive plate and said collar, at least one filter element having two electrodes, the filter element disposed in said recess between said collar and one of said conductive plates wherein one of said two electrodes is electrically connected to said conductive plate, the connector further comprising a conductive shield, and the other one of said two electrodes engages said shield.

2. A filtered electrical connector as recited in claim 1 said housing further comprising a floor disposed at a right angle relative to an inside wall of said collar wherein said floor defines a limit of said recess and said filter element engages said inside wall of said collar, said conductive plate and said floor.

3. A filtered electrical connector as recited in claim 2 wherein said shield is electrically conductive and is held at ground potential.

4. A filtered electrical connector as recited in claim 2, wherein said inside wall of said collar and said floor are integral with each other.

5. A filtered electrical connector as recited in claim 1, and said contact further comprising a spacer, and an insulation displacement section, said filter element engaging said plate.

6. A filtered electrical connector as recited in claim 1 wherein said shield is electrically conductive.

7. A filtered electrical connector as recited in claim 6 wherein said filter element is adhered to said shield with conductive adhesive.

8. A filtered electrical connector as recited in claim 1 wherein the shield captivates the filter element within the housing.

9. A filtered electrical connector as recited in claim 7, said shield further comprising an alignment shoulder.

10. A filtered electrical connector as recited in claim 2, wherein said collar and said floor are integral with each other.

11. A filtered electrical connector as recited in claim 1 wherein the shield comprises a conductive member disposed on said collar of the connector.

12. A filtered electrical connector as recited in claim 11 wherein the shield is disposed on the inside wall of the collar.

13. A filtered electrical connector as recited in claim 11 and further comprising a strain relief interfering with disengagement of said filter element from said housing.

14. A filtered electrical connector comprising a plurality of contacts held in an insulative housing, each contact further comprising a contact pin and a conductive plate perpendicular to the mating direction of the connector and integral with said contact pin, said housing comprising a collar parallel to and spaced away from said conductive plate creating a recess between said conductive plate and said collar, said housing having a conductive shield and wherein there is a filter element interposed between said collar and said conductive plate and engaging said shield.

15. A filtered electrical connector as recited in claim 14 said collar having an inside wall and said housing further comprising a floor disposed at a right angle relative to the inside wall, said filter element engaging said inside wall, said floor, and said conductive plate.

16. A filtered electrical connector as recited in claim 14 wherein said contact further comprises a spacer, and an insulation displacement section.

17. A filtered electrical connector as recited in claim 14 wherein said shield is electrically conductive.

18. A filtered electrical connector as recited in claim 14, wherein said floor, and said inside wall of said collar are integral with each other.

19. A filtered electrical connector as recited in claim 15, wherein said floor, and said inside wall of said collar are integral with each other.

20. A filtered electrical connector as recited in claim 17 wherein the shield captivates the filter element within the housing.

21. A filtered electrical connector as recited in claim 20, said shield further comprising an alignment shoulder.

22. A filtered electrical connector as recited in claim 14 and further comprising a strain relief interfering with disengagement of said filter element from said housing.

23. A filtered electrical connector as recited in claim 16 and further comprising a conductor terminated in the insulation displacement section and a strain relief interfering with disengagement of said filter element from said housing.

24. A filtered electrical adapter comprising a first connector comprising a plurality of contacts held in an insulative first housing, and a second connector comprising a plurality of said contacts held in an insulative second housing, the adapter further comprising a shield, each contact held in said first and second housings comprising a contact pin and a conductive plate perpendicular to the mating direction of the connector and in electrical communication with said contact pin, at least one of said contacts in a first housing being electrically interconnected to a respective one of said contacts in said second housing and a filter element disposed between said collar of said first housing and said conductive plate of at least one contact in said first housing, said filter element also engaging said shield.

25. A filtered electrical adapter as recited in claim 24, wherein said contacts in said first and said second housings, further comprise a conductive insulation displacement section and a wire is terminated in said insulation displacement section of one of the contacts in said first housing and said insulation displacement section in a respective one of said contacts in said second housing.

26. A filtered electrical adapter as recited in claim 24 each first and second housing further comprising a floor disposed at a right angle relative to an inside wall of said collar, said filter element engaging said inside wall, said floor, and said conductive plate.

27. A filtered electrical adapter as recited in claim 24 wherein said contact further comprises a spacer, and an insulation displacement section.

28. A filtered electrical adapter as recited in claim 24 wherein said shield is electrically conductive.

29. A filtered electrical connector as recited in claim 28 wherein the shield captivates the filter element within the housing.

30. A filtered electrical connector as recited in claim 28, said shield further comprising an alignment shoulder.

31. A filtered electrical connector as recited in claim 24 wherein said filter element is adhered to said shield with conductive adhesive.

32. A filtered electrical adapter as recited in claim 24, wherein said inside wall of said collar and said floor are integral with each other.

33. A filtered electrical connector as recited in claim 24 wherein said shield comprises a conductive member disposed on said collar of the connector.

34. A filtered electrical connector as recited in claim 24 wherein said shield comprises a conductive member disposed in said inside wall of said housing.

35. A filtered electrical connector as recited in claim 34 and further comprising a strain relief interfering with disengagement of said filter element from said housing.

* * * * *